US006974789B1

(12) United States Patent
Whitaker et al.

(10) Patent No.: US 6,974,789 B1
(45) **Date of Patent: *Dec. 13, 2005**

(54) DETERGENT TABLET

(75) Inventors: Joanne Louise Whitaker, Newcastle upon Tyne (GB); Eric Tcheou, Brussels (BE); Neil Joseph Lant, Newcastle upon Tyne (GB); Christopher James Binder, Tynemouth (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/889,628

(22) PCT Filed: Jan. 20, 2000

(86) PCT No.: PCT/US00/01389

§ 371 (c)(1),
(2), (4) Date: Jul. 19, 2001

(87) PCT Pub. No.: WO00/43488

PCT Pub. Date: Jul. 27, 2000

(30) Foreign Application Priority Data

Jan. 23, 1999 (GB) ..... 9901408
Jan. 13, 2000 (GB) ..... 0000629

(51) Int. Cl.[7] ..... C11D 17/00; C11D 3/37
(52) U.S. Cl. ..... 510/294; 510/298; 510/446; 510/473; 510/474; 510/475
(58) Field of Search ..... 510/294, 298, 510/446, 473, 474, 475

(56) References Cited

U.S. PATENT DOCUMENTS

| | | | | |
|---|---|---|---|---|
| 3,951,821 | A * | 4/1976 | Davidson | 252/1 |
| 4,460,490 | A | 7/1984 | Barford et al. | 510/192 |
| 5,900,399 | A * | 5/1999 | Seiter et al. | 510/446 |
| 6,051,545 | A * | 4/2000 | Boskamp | 510/446 |
| 6,329,334 | B1 * | 12/2001 | Bertleff et al. | 510/445 |
| 6,358,910 | B1 * | 3/2002 | Boskamp et al. | 510/446 |
| 6,372,707 | B1 * | 4/2002 | Boskamp et al. | 510/440 |
| 6,544,943 | B1 * | 4/2003 | Ricci et al. | 510/446 |
| 6,544,944 | B1 * | 4/2003 | Ricci et al. | 510/446 |
| 6,551,981 | B1 * | 4/2003 | Ricci et al. | 510/446 |
| 6,551,982 | B1 * | 4/2003 | Ricci et al. | 510/446 |
| 6,589,932 | B1 * | 7/2003 | Ricci et al. | 510/446 |
| 6,686,328 | B1 * | 2/2004 | Binder | 510/446 |
| 6,770,616 | B1 * | 8/2004 | McGowan et al. | 510/446 |

FOREIGN PATENT DOCUMENTS

| | | | |
|---|---|---|---|
| EP | 0 799 886 | A2 | 10/1997 |
| EP | 0838519 | A1 * | 4/1998 |
| EP | 0 922 756 | A1 | 6/1999 |
| GB | 1 307 387 | | 2/1973 |
| WO | WO 92/20774 | A1 * | 11/1992 |
| WO | WO 98/40462 | A1 * | 9/1998 |
| WO | WO 98/45400 | | 10/1998 |
| WO | WO 99/53014 | | 10/1999 |

* cited by examiner

*Primary Examiner*—Lorna M. Douyon

(74) *Attorney, Agent, or Firm*—Kim W. Zerby; Steven W. Miller

(57) ABSTRACT

A detergent tablet for use in a washing machine, the tablet having one or more phases at least one of which is in the form of a compressed particulate solid comprising a) a polymeric disintegrant having a particle size distribution such that at least 90% by weight thereof has a particle size below about 0.3 mm and at least 30% by weight thereof has a particle size below about 0.2 mm; and b) a water-soluble hydrated salt having a melting point in the range from about 30° C. to about 95° C. The detergent tablets display improved dissolution, strength and long-term storage characteristics.

14 Claims, No Drawings

DETERGENT TABLET

TECHNICAL FIELD

The present invention relates to detergent tablets. In particular, it relates to single and multi-phase detergent tablets having improved strength, especially on long-term storage, together with excellent dissolution characteristics.

BACKGROUND

Detergent compositions in tablet form are known in the art. It is understood that detergent compositions in tablet form hold several advantages over detergent compositions in particulate form, such as ease of dosing, handling, transportation and storage.

Detergent tablets are most commonly prepared by premixing components of a detergent composition and forming the pre-mixed detergent components into a tablet using any suitable equipment, preferably a tablet press. Tablets are typically formed by compression of the components of the detergent composition so that the tablets produced are sufficiently robust to be able to withstand handling and transportation without sustaining damage. In addition to being robust, tablets must also dissolve sufficiently fast so that the detergent components are released into the wash water as soon as possible at the beginning of the wash cycle.

However, a dichotomy exists in that as compression force is increased, the rate of dissolution of the tablets becomes slower. A low compression force, on the other hand, improves dissolution but at the expense of tablet strength. This problem is compounded by the fact that conventional tablet compositions have relatively poor long-term storage-stability characteristics and, to compensate, have to be manufactured to a higher compression specification. The present invention therefore seeks to provide tablet compositions having improved tablet dissolution characteristics and which at the same time delivers excellent long-term storage-stability characteristics in terms of strength and robustness.

Polymeric disintegrants and water-soluble hydrated salts such as sodium acetate trihydrate are well-known components of tablet compositions. It has now been discovered, however, that mixtures of polymeric disintegrants of defined particle size distribution together with certain water-soluble hydrated salts are particularly beneficial for improving the dissolution behaviour of detergent tablets whilst at the same time providing excellent strength and robustness characteristics during long-term storage.

The present invention therefore provides single and multi-phase detergent tablets for use in automatic dishwashing, laundry, etc and which display improved dissolution, strength and long-term storage characteristics. Tablet compositions formulated for use in automatic dishwashing machines are particularly preferred herein.

SUMMARY OF THE INVENTION

According to a first aspect of the invention, there is provided a detergent tablet for use in a washing machine, the tablet having one or more phases at least one of which is in the form of a compressed particulate solid comprising:

a) a polymeric disintegrant having a particle size distribution such that at least 90% by weight thereof has a particle size below about 0.3 mm and at least 30% by weight thereof has a particle size below about 0.2 mm; and b) a water-soluble hydrated salt having a solubility in distilled water of at least about 25 g/100 g at 25° C.

In preferred embodiments, the polymeric disintegrant has a particle size distribution such that at least 90% by weight thereof has a particle size below about 0.25 mm and at least 50% by weight thereof has a particle size below about 0.2 mm. Moreover, preferred disintegrants have a particle size distribution such that at least 90% by weight thereof has a particle size above about 0.05 mm, preferably above about 0.075 mm.

In general terms, tablet disintegrating agents can be described as materials that enhance the rate of tablet dissolution in the wash liquor. Suitable polymeric disintegrants for use herein include polymers that swell on contact with water as well as those that facilitate water influx and/or efflux by forming channels in the detergent tablet. Certain polymeric disintegrating agents suitable for use herein can also act as tablet binders—in other words, they act to increase tablet strength as well as enhancing dissolution rate. Polymeric disintegrants preferred for use herein include starch and cellulose and derivatives thereof, alginates, sugars, polyvinylpyrrolidones, swellable clays, and mixtures thereof. Examples of suitable disintegrating agent include starch and cellulose-based materials such as Arbocel (tradename), Vivapur (tradename) both available from Rettenmaier, Nymcel (tradename) available from Metsa-serla, burkeite, methyl cellulose, hydroxypropylcellulose, carboxymethylcellulose, cross-linked celluloses such as cross-linked carboxymethylcellulose (CMC), dextrans, cross-linked polyvinylpyrrolidones. Of these Vivapur and in particular Vivapur G200 (a microcrystalline cellulose having an average particle size of about 0.18 mm) is particularly preferred from the viewpoint of providing both enhanced dissolution rate and tablet strength as well as excellent storage stability.

The water-soluble hydrated salt, on the other hand, is preferably soluble to the extent of at least about 40 g/100 g, more preferably at least about 60 g/100 g of distilled water at 25° C. In addition, the water-soluble hydrated salt preferably has a melting point in the range from about 30° C. to about 95° C., more preferably from about 30° C. to about 75° C. Preferred water-soluble hydrated salts are selected from hydrates of sodium acetate, sodium metaborate, sodium orthophosphate, sodium dihydrogenphosphate, disodium hydrogen phosphate, sodium potassium tartrate, potassium aluminium sulphate, calcium bromide, calcium nitrate, sodium citrate, potassium citrate and mixtures thereof. Particularly suitable materials include sodium acetate trihydrate, sodium metaborate tetrahydrate or octahydrate, sodium orthophosphate dodecahydrate, sodium dihydrogen phosphate dihydrate, the di-, hepta- or dodecahydrate of disodium hydrogen phosphate, sodium potassium tartrate tetrahydrate, potassium aluminium sulphate dodecahydrate, calcium bromide hexahydrate, tripotassium citrate monohydrate, calcium nitrate tetrahydrate and sodium citrate dihydrate. In preferred embodiments, the water-soluble hydrated salt is selected from water-soluble mono-, di-tri- and tetrahydrate salts and mixtures thereof. Highly preferred herein is sodium acetate trihydrate, tripotassium citrate monohydrate, mixed alkali-metal citrates containing at least one potassium ion and mixtures thereof. Highly preferred are sodium acetate trihydrate and tripotassium citrate monohydrate.

In preparing the detergent tablets of the invention, the particulate solid comprising polymeric disintegrant and hydrated salt will normally be compressed at a pressure of at least about 10 kg/cm$^2$, preferably at least about 40 kg/cm$^2$, more preferably at least about 250 kg/cm$^2$, and especially at least about 350 kg/cm$^2$. In general, the detergent tablets of the invention contain from about 0.5% to about 10%, preferably from about 0.8% to about 5%, more preferably from about 1% to about 3% by weight of each of the polymeric disintegrant and water-soluble hydrated salt.

The detergent tablets of the invention include both single and multi-phase tablets. Multi-phase detergent tablets suitable herein will normally comprise a first phase in adhesive contact with one or more second phases (sometimes referred to herein as 'optional subsequent phases'). In preferred embodiments, the first phase is a compressed shaped body prepared at an applied compression pressure of at least about 250 kg/cm$^2$, preferably at least about 350 kg/cm$^2$ (3.43 kN/cm$^2$ or 34.3 MPa), more preferably from about 400 to about 2000 kg/cm$^2$, and especially from about 600 to about 1200 kg/cm$^2$ (compression pressure herein is the applied force divided by the cross-sectional area of the tablet in a plane transverse to the applied force—in effect, the transverse cross-sectional area of the die of the rotary press). The second phase, on the other hand, is preferably formed at a compression pressure of less than about 350 kg/cm$^2$, preferably in the range from about 40 kg/cm$^2$ to about 300 kg/cm$^2$ and more preferably from about 70 to about 270 kg/cm$^2$. In preferred embodiments, moreover, the first phase is formed by compression at a pressure greater than that applied to the second phase. In these embodiments, the compression pressures applied to the first and second phases will generally be in a ratio of at least about 1.2:1, preferably at least about 2:1, more preferably at least about 4:1. The polymeric disintegrant and hydrated salt defined herein will normally be incorporated as part of the first phase although they can also be included in the second and optional subsequent phases.

Although simple multi-layer tablets are envisaged for use herein, preferred from the viewpoint of optimum product integrity, strength (measured for example by the Child Bite Strength [CBS] test) and dissolution characteristics are multi-phase tablets comprising a first phase in the form of a shaped body having at least one mould therein; and a second phase in the form of a particulate solid compressed within said mould. Such embodiments are sometimes referred to herein as 'mould' embodiments. The tablets of the invention, both mould embodiments and otherwise, will preferably have a CBS of at least about 6 kg, preferably greater than about 8 kg, more preferably greater than about 10 kg, especially greater than about 12 kg, and more especially greater than about 14 kg, CBS being measured per the US Consumer Product Safety Commission Test Specification.

In the multi-phase embodiments of the invention, it is also preferred that the first and second phases herein are in a relatively high weight ratio to one another, for example at least about 6:1, preferably at least about 10:1; also that the tablet composition contain one or more detergent actives (for example enzymes, bleaches, bleach activators, bleach catalysts, surfactants, chelating agents etc) which is predominantly concentrated in the second phase, for example, at least about 50%, preferably at least about 60%, especially about 80% by weight of the active (based on the total weight of the active in tablet) is in the second phase of the tablet. Again, such compositions are optimum for tablet strength, dissolution, cleaning, and pH regulation characteristics providing, for example, tablet compositions capable of dissolving in the wash liquor so as to deliver at least 50%, preferably at least 60%, and more preferably at least 80% by weight of the detergent active to the wash liquor within 10, 5, 4 or even 3 minutes of the start of the wash process.

The compositions herein are preferably include an effervescent agent, such agents being preferred in combination with polymeric disintegrant and water-soluble salt from the viewpoint of providing optimum tablet dissolution and strength characteristics.

Thus according to another apect of the invention there is provided a detergent tablet for use in a washing machine, the tablet having one or more phases at least one of which is in the form of a compressed particulate solid comprising:

a) a polymeric disintegrant; b) a water-soluble hydrated salt having a solubility in distilled water of at least about 25 g/100 g at 25° C.; and optionally c) an effervescent agent.

DETAILED DESCRIPTION OF THE INVENTION

It is an object of the present invention to provide a detergent tablet that is not only sufficiently robust to withstand handling and transportation, but also at least a significant portion of which dissolves rapidly in the wash water providing rapid delivery of detergent active. It is preferred that at least one phase of the tablet dissolves in the wash water within the first ten minutes, preferably five minutes, more preferably four minutes of the wash cycle of an automatic dishwashing or laundry washing machine. Preferably the washing machine is either an automatic dishwashing or laundry washing machine. The time within which the multi-phase tablet or a phase thereof or a detergent active component dissolves is determined according to DIN 44990 using a dishwashing machine available from Bosch on the normal 65° C. washing program with water hardness at 18°H using a minimum of six replicates or a sufficient number to ensure reproducibility.

The detergent tablets of the present invention comprise a first phase and, in multi-phase tablet embodiments, also comprise a second and optional subsequent phases. The first phase is in the form of a shaped body of detergent composition comprising one or more detergent components as described below. Other than the hereindefined polymeric disintegrant and hydrated salt, preferred detergent components of the first phase include other builder components, bleach, enzymes, effervescent agents and surfactant. The components of the detergent composition are mixed together by, for example admixing dry components or spraying-on liquid components. The components are then formed into a first phase using any suitable compression equipment, but preferably in a tablet press.

In mould embodiments, the first phase is prepared such that it comprises at least one mould in the surface of the shaped body. In a preferred embodiment the mould is created using a specially designed tablet press wherein the surface of the punch that contacts the detergent composition is shaped such that when it contacts and presses the detergent composition it presses a mould, or multiple moulds into the first phase of the multi-phase detergent tablet. Preferably, the mould will have an inwardly concave or generally concave surface to provide improved adhesion to the second phase.

The tablets of the invention can also include one or more additional phases prepared from a composition or compositions which comprise one or more detergent components as described below. At least one phase (herein referred to as a second phase) preferably takes the form of a particulate solid (which term encompasses powders, granules, agglomerates, and other particulate solids including mixtures thereof with liquid binders, meltable solids, spray-ons, etc)

compressed either as a layer or into/within the one or more moulds of the first phase of the detergent tablet such that the second phase itself takes the form of a shaped body. Preferred detergent components include builders, colourants, binders, surfactants, effervescent agents and enzymes, in particular amylase and protease enzymes. Suitable effervescing agents are those that produce a gas, especially oxygen, nitrogen dioxide or carbon dioxide, on contact with water. Examples of suitable effervescent agents include perborate, percarbonate, carbonate, bicarbonate in combination with inorganic acids such as sulphamic acid and/or carboxylic acids such as citric, malic and maleic acid and mixtures thereof.

The components of the detergent composition are mixed together by for example premixing dry components and admixing, preferably by spray-on, liquid components. The components of the second and optional subsequent phases are then compressed to form one or more layers or are fed into and retained within the mould provided by the first phase.

The preferred mould embodiments of the present invention comprises two phases; a first and a second phase. The first phase will normally comprise one mould and the second phase will normally consist of a single detergent active composition. However, it is envisaged that the first phase may comprise more than one mould and the second phase may be prepared from more than one detergent active composition. Furthermore, it is also envisaged that the second phase may comprise more than one detergent active composition contained within one mould. It is also envisaged that several detergent active compositions are contained in separate moulds. In this way potentially chemically sensitive detergent components can be separated in order to avoid any loss in performance caused by components reacting together and potentially becoming inactive or exhausted.

In a preferred aspect of the present invention the first, second and/or optional subsequent phases can additionally comprise a non-disintegrant binder, i.e., a material that increases tablet strength without increasing tablet dissolution rate. Preferred non-disintegrant binders are selected from polyethylene and/or polypropylene glycols, for example polyethylene and/or polypropylene glycols having an average molecular weight of from about 1000 to about 12000, especially those of molecular weight 4000, 6000 and 9000. The polyethyleneglycol non-disintegrant binders are highly preferred herein.

In a preferred aspect of the present invention the first phase weighs greater than 4 g. More preferably the first phase weighs from 10 g to 30 g, even more preferably from 15 g to 25 g and most preferably form 18 g to 24 g. The second and optional subsequent phases weigh less than 4 g. More preferably the second and/or optional subsequent phases weigh between 1 g and 3.5 g, most preferably from 1.3 g to 2.5 g.

The detergent tablets are prepared using any suitable tabletting equipment. Preferably multi-phase tablets herein are prepared by compression in a tablet press capable of preparing a tablet comprising a mould. In a particularly preferred embodiment of the present invention the first phase is prepared using a specially designed tablet press. The punch(es) of this tablet press are modified so that the surface of the punch that contacts the detergent composition has a convex surface.

A first detergent composition including the hereindefined polymeric disintegrant and hydrated salt, is delivered into the die of the tablet press and the punch is lowered to contact and then compress the detergent composition to form a first phase. The first detergent composition is compressed using an applied pressure of at least 250 kg/cm$^2$, preferably between 350 and 2000 kg/cm$^2$, more preferably 500 to 1500 kg/cm$^2$, most preferably 600 to 1200 kg/cm$^2$. The punch is then elevated, exposing the first phase containing a mould. A second and optional subsequent detergent composition(s) is then delivered into the mould. The specially designed tablet press punch is then lowered a second time to lightly compress the second and optional subsequent detergent composition(s) to form the second and optional subsequent phase(s). In another embodiment of the present invention where an optional subsequent phase is present the optional subsequent phase is prepared in a subsequent compression step substantially similar to the second compression step described above. The second and optional subsequent detergent composition(s) is compressed at a pressure of preferably less than 350 kg/cm$^2$, more preferably from 40 to 300 kg/cm$^2$, most preferably from 70 to 270 kg/cm$^2$. After compression of the second detergent composition, the punch is elevated a second time and the multi-phase detergent tablet is ejected from the tablet press. Single and multi-layer tablets without moulds can be prepared in a similar manner except using a tablet punch having a planar surface.

The detergent tablets of the invention are prepared by compression of one or more compositions comprising detergent active components. Suitably, the compositions may include a variety of different detergent components including builder compounds, surfactants, enzymes, bleaching agents, alkalinity sources, colourants, perfume, lime soap dispersants, organic polymeric compounds including polymeric dye transfer inhibiting agents, crystal growth inhibitors, heavy metal ion sequestrants, metal ion salts, enzyme stabilisers, corrosion inhibitors, suds suppressers, solvents, fabric softening agents, optical brighteners and hydrotropes. In the following, the proportions of these active components are given by weight of the corresponding composition of active detergent components, unless specified otherwise.

In multi-phase tablets, highly preferred detergent components of the first phase include a builder compound, a surfactant, an enzyme and a bleaching agent. Highly preferred detergent components of the second phase include builder, enzymes and disrupting agent.

Builders suitable for use herein include water-soluble builders such as citrates, carbonates and polyphosphates e.g. sodium tripolyphosphate and sodium tripolyphosphate hexahydrate; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as choline esters (U.S. Pat. No. 4,228,042, U.S. Pat. No. 4,239,660 and U.S. Pat. No. 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF 18 B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the amine oxides and alkyl amphocarboxylicc surfactants such as Miranol™ C2M; and zwitterionic surfactants such as the betaines and sultaines; and mixtures thereof.

Surfactants suitable herein are disclosed, for example, in U.S. Pat. No. 3,929,678, US-A4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. In the preferred dishwashing aspect of the invention, the surfactant level is generally from about 1% to about 5% by weight of composition.

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); and α and β amylases such as Purafect Ox Am$^R$ (Genencor) and Termamyl$^R$, Ban$^R$, Fungamyl$^R$, Duramyl$^R$, and Natalase$^R$ (Novo); and mixtures thereof. Enzymes are preferably added herein as prills, granulates, or cogranulates at levels typically in the range from about 0.0001% to about 2% pure enzyme by weight of composition.

Bleaching agents suitable herein include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt).

Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes(U.S. Pat. No. 4,810,410).

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein, especially for use in dishwashing, can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colourants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay and cationic fabric softeners.

Detergent components suitable for use herein are described in more detail in the Appendix to the Description (Ref: ADW1L).

The detergent tablets herein are preferably formulated to have a not unduly high pH, preferably a pH in 1% solution in distilled water of from about 8.0 to about 12.5, more preferably from about 9.0 to about 11.8, most preferably from about 9.5 to about 11.5.

A preferred machine dishwashing method comprises treating soiled articles selected from crockery, glassware, silverware, metallic items, cutlery and mixtures thereof, with an aqueous liquid having dissolved or dispensed therein an effective amount of a the herein described compositions. By an effective amount is meant from 8 g to 60 g of product dissolved or dispersed in a wash solution of volume from 3 to 10 liters, as are typical product dosages and wash solution volumes commonly employed in conventional machine dishwashing methods. Preferably the detergent tablets are from 15 g to 40 g in weight, more preferably from 20 g to 35 g in weight.

Machine laundry methods herein typically comprise treating soiled laundry with an aqueous wash solution in a washing machine having dissolved or dispensed therein an effective amount of the herein described compositions. By an effective amount is meant from 40 g to 300 g of product dissolved or dispersed in a wash solution of volume from 5 to 65 liters, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle.

Alternatively, the dispensing device may be a flexible container, such as a bag or pouch. The bag may be of fibrous construction coated with a water impermeable protective material so as to retain the contents, such as is disclosed in EP-A-0018678. Alternatively it may be formed of a water-insoluble synthetic polymeric material provided with an edge seal or closure designed to rupture in aqueous media as disclosed in EP-A-0011500, EP-A-0011501, EP-A-0011502, and EP-A-0011968. A convenient form of water frangible closure comprises a water soluble adhesive disposed along and sealing one edge of a pouch formed of a water impermeable polymeric film such as polyethylene or polypropylene.

EXAMPLES

Abbreviations used in Examples

In the detergent compositions, the abbreviated component identifications have the following meanings:

| | |
|---|---|
| STPP | Sodium tripolyphosphate |
| Bicarbonate | Sodium hydrogen carbonate |
| Citric Acid | Anhydrous Citric acid |
| Carbonate | Anhydrous sodium carbonate |
| Citrate | Tripotassium citrate monohydrate |
| Silicate | Amorphous Sodium Silicate ($SiO_2$:$Na_2O$ ratio = 2.0) |
| SKS-6 | Crystalline layered silicate of formula $\delta$-$Na_2Si_2O_5$ |
| PB1 | Anhydrous sodium perborate monohydrate |
| Nonionic | $C_{13}$–$C_{15}$ mixed ethoxylated/propoxylated fatty alcohol with an average degree of ethoxylation of 3.8 and an average degree of propoxylation of 4.5, sold under the tradename Plurafac by BASF |
| TAED | Tetraacetyl ethylene diamine |
| HEDP | Ethane 1-hydroxy-1,1-diphosphonic acid |
| PAAC | Pentaamine acetate cobalt (III) salt |
| Paraffin | Paraffin oil sold under the tradename Winog 70 by Wintershall. |
| Protease | Proteolytic enzyme |
| Amylase | Amylolytic enzyme. |
| BTA | Benzotriazole |
| Sulphate | Anhydrous sodium sulphate. |
| Triacetate | Sodium acetate trihydrate |
| Vivapur G200 | Microcrystalline cellulose having average particle size of 0.18 mm |
| PEG 400 | Polyethylene Glycol molecular weight approximately 400 available from Hoechst |
| PEG 4000 | Polyethylene Glycol molecular weight approximately 4000 available from Hoechst |

In the following examples all levels are quoted as parts by weight:

Examples I–VI

The following illustrates detergent tablets of the present invention suitable for use in a dishwashing machine.

| | I | II | III | IV | V | VI |
|---|---|---|---|---|---|---|
| Phase I | | | | | | |
| STPP | | 9.6 | | | | 11.5 |
| Silicate | 1.7 | 0.67 | 1.6 | 1.0 | 1.0 | 2.4 |
| SKS-6 | 2.5 | 1.5 | | 2.3 | 2.25 | |
| Carbonate | 5.00 | 2.74 | 3.5 | 3.59 | 4.10 | 5.25 |
| HEDP | 0.25 | 0.18 | 0.18 | 0.28 | 0.28 | 0.28 |
| PB1 | 3.5 | 2.45 | 2.45 | 3.68 | 3.68 | 3.68 |
| PAAC | 0.002 | 0.002 | 0.002 | 0.003 | 0.004 | 0.004 |
| Triacetate | 0.5 | 0.6 | 0.5 | 0.4 | 0.8 | 0.5 |
| Vivapur G200 | 0.75 | 0.7 | 0.65 | 0.8 | 0.4 | 0.75 |
| Amylase | 0.148 | 0.110 | 0.110 | 0.252 | 0.163 | 0.163 |
| Protease | 0.06 | 0.06 | 0.06 | 0.09 | 0.09 | 0.09 |
| Nonionic | 0.90 | 0.80 | 0.80 | 1.20 | 1.20 | 1.20 |
| PEG 4000 | 0.4 | 0.26 | 0.26 | 0.38 | 0.39 | 0.39 |
| BTA | 0.01 | 0.04 | 0.04 | | 0.06 | 0.06 |
| Paraffin | 0.16 | 0.10 | 0.10 | 0.15 | 0.15 | 0.15 |
| Perfume | 0.02 | 0.02 | 0.02 | 0.013 | 0.013 | 0.013 |
| Sulphate | | | | 0.502 | 0.05 | 2.843 |
| Total | 15.9 g | 19.83 g | 10.27 g | 14.64 g | 14.63 g | 29.3 g |
| Phase 2 | | | | | | |
| Amylase | 0.30 | 0.35 | 0.25 | 0.30 | 0.35 | 0.25 |
| Protease | 0.25 | 0.22 | 0.30 | 0.25 | 0.22 | 0.30 |
| Citric acid | 0.3 | | 0.30 | 0.3 | | 0.30 |
| Sulphamic acid | | 0.3 | | | 0.3 | |

-continued

| | I | II | III | IV | V | VI |
|---|---|---|---|---|---|---|
| Bicarbonate | 0.92 | 0.45 | 0.45 | 1.09 | 0.45 | 0.45 |
| Carbonate | | 0.55 | | | 0.55 | |
| Silicate | | | 0.64 | | | 0.64 |
| $CaCl_2$ | | 0.07 | | | 0.07 | |
| PEG 400 | 0.15 | | | | | |
| PEG 4000 | 0.08 | 0.06 | 0.06 | 0.06 | 0.06 | 0.06 |
| Total | 2.0 g | 2.0 g | 2.0 g | 2.0 g | 2.0 g | 2.0 g |

The tablet compositions are prepared as follows. The detergent active composition of phase 1 is prepared by admixing the granular and liquid components and is then passed into the die of a conventional rotary press. The press includes a punch suitably shaped for forming a mould. The cross-section of the die is approximately 30×38 mm. The composition is then subjected to a compression force of 940 kg/cm$^2$ and the punch is then elevated exposing the first phase of the tablet containing the mould in its upper surface. The detergent active composition of phase 2 is prepared in similar manner and is passed into the die. The particulate active composition is then subjected to a compression force of 170 kg/cm$^2$, the punch is elevated, and the multi-phase tablet ejected from the tablet press. The resulting tablets display improved dissolution, strength and long-term storage characteristics.

Examples VII–XII

The following illustrates further detergent tablets of the present invention suitable for use in a dishwashing machine.

| | VII | VIII | IX | X | XI | XII |
|---|---|---|---|---|---|---|
| Phase I | | | | | | |
| STPP | | 9.6 | | | | 11.5 |
| Silicate | 1.7 | 0.67 | 1.6 | 1.0 | 1.0 | 2.4 |
| SKS-6 | 2.5 | 1.5 | | 2.3 | 2.25 | |
| Carbonate | 5.00 | 2.74 | 3.5 | 3.59 | 4.10 | 5.25 |
| HEDP | 0.25 | 0.18 | 0.18 | 0.28 | 0.28 | 0.28 |
| PB1 | 3.5 | 2.45 | 2.45 | 3.68 | 3.68 | 3.68 |
| PAAC | 0.002 | 0.002 | 0.002 | 0.003 | 0.004 | 0.004 |
| Citrate | 0.5 | 0.6 | 0.5 | 0.4 | 0.8 | 0.5 |
| Vivapur G200 | 0.75 | 0.7 | 0.65 | 0.8 | 0.4 | 0.75 |
| Amylase | 0.148 | 0.110 | 0.110 | 0.252 | 0.163 | 0.163 |
| Protease | 0.06 | 0.06 | 0.06 | 0.09 | 0.09 | 0.09 |
| Nonionic | 0.90 | 0.80 | 0.80 | 1.20 | 1.20 | 1.20 |
| PEG 4000 | 0.4 | 0.26 | 0.26 | 0.38 | 0.39 | 0.39 |
| BTA | 0.01 | 0.04 | 0.04 | | 0.06 | 0.06 |
| Paraffin | 0.16 | 0.10 | 0.10 | 0.15 | 0.15 | 0.15 |
| Perfume | 0.02 | 0.02 | 0.02 | 0.013 | 0.013 | 0.013 |
| Sulphate | | | | 0.502 | 0.05 | 2.843 |
| Total | 15.9 g | 19.83 g | 10.27 g | 14.64 g | 14.63 g | 29.3 g |
| Phase 2 | | | | | | |
| Amylase | 0.30 | 0.35 | 0.25 | 0.30 | 0.35 | 0.25 |
| Protease | 0.25 | 0.22 | 0.30 | 0.25 | 0.22 | 0.30 |
| Citric acid | 0.3 | | 0.30 | 0.3 | | 0.30 |
| Sulphamic acid | | 0.3 | | | 0.3 | |
| Bicarbonate | 0.92 | 0.45 | 0.45 | 1.09 | 0.45 | 0.45 |
| Carbonate | | 0.55 | | | 0.55 | |
| Silicate | | | 0.64 | | | 0.64 |
| $CaCl_2$ | | 0.07 | | | 0.07 | |

-continued

| | VII | VIII | IX | X | XI | XII |
|---|---|---|---|---|---|---|
| PEG 400 | 0.15 | | | | | |
| PEG 4000 | 0.08 | 0.06 | 0.06 | 0.06 | 0.06 | 0.06 |
| Total | 2.0 g | 2.0 g | 2.0 g | 2.0 g | 2.0 g | 2.0 g |

The tablet compositions are prepared as those in examples I to VI. The resulting tablets display improved dissolution, strength and long-term storage characteristics.

APPENDIX TO THE DESCRIPTION

Builders

Water-Soluble Builder Compound

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in GB-A-1,379,241, lactoxysuccinates described in GB-A-1,389,732, and aminosuccinates described in NL-A-7205873, and the oxypolycarboxylate materials such as 2-oxa-1,1,3-propane tricarboxylates described in GB-A-1,387,447.

Polycarboxylate containing four carboxy groups include oxydisuccinates disclosed in GB-A-1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in GB-A-1,398,421, GB-A-1,398,422 and U.S. Pat. No. 3,936,448, and the sulfonated pyrolysed citrates described in GB-A-1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in GB-A-1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that 50° C., especially less than 40° C.

Examples of carbonate builders are the alkaline earth and alkali metal carbonates, including sodium carbonate and sesqui-carbonate and mixtures thereof with ultra-fine calcium carbonate as disclosed in DE-A-2,321,001.

Highly preferred builder compounds for use in the present compositions are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Partially Soluble or Insoluble Builder Compound

The compositions herein can contain a partially water-soluble or water-insoluble builder compound. Partially soluble and insoluble builder compounds are particularly suitable for use in tablets prepared for use in laundry cleaning methods. Examples of partially water soluble builders include the crystalline layered silicates as disclosed for example, in EP-A-0164514 and EP-A-0293640. Preferred are the crystalline layered sodium silicates of general formula $$NaMSi_xO_{2+1}.yH_2O$$

wherein M is sodium or hydrogen, x is a number from 1.9 to 4 and y is a number from 0 to 20. Crystalline layered sodium silicates of this type preferably have a two dimensional 'sheet' structure, such as the so called δ-layered structure, as described in EP-A-0164514 and EP-A-0293640. Methods for preparation of crystalline layered silicates of this type are disclosed in DE-A-3417649 and DE-A-3742043. For the purpose of the present invention, x in the general formula above has a value of 2,3 or 4 and is preferably 2.

The most preferred crystalline layered sodium silicate compound has the formula $\delta$-$Na_2Si_2O_5$, known as NaSKS-6 (trade name), available from Hoechst AG.

The crystalline layered sodium silicate material can be added, especially in granular detergent compositions, as a particulate in intimate admixture with a solid, water-soluble ionisable material as described in WO-A-92/18594. The solid, water-soluble ionisable material is selected from organic acids, organic and inorganic acid salts and mixtures thereof, with citric acid being preferred.

Examples of largely water insoluble builders include the sodium aluminosilicates. Suitable aluminosilicates include the aluminosilicate zeolites having the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof.

A preferred method of synthesizing aluminosilicate zeolites is that described by Schoeman et al (published in Zeolite (1994) 14(2), 110–116), in which the author describes a method of preparing colloidal aluminosilicate zeolites. The colloidal aluminosilicate zeolite particles should preferably be such that no more than 5% of the particles are of size greater than 1 μm in diameter and not more than 5% of particles are of size less then 0.05 μm in diameter. Preferably the aluminosilicate zeolite particles have an average particle size diameter of between 0.01 μm and 1 μm, more preferably between 0.05 μm and 0.9 μm, most preferably between 0.1 μm and 0.6 μm.

Zeolite A has the formula $$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}]. 276H_2O$. Zeolite MAP, as disclosed in EP-B-384,070 is a suitable zeolite builder herein.

Preferred aluminosilicate zeolites are the colloidal aluminosilicate zeolites. When employed as a component of a detergent composition colloidal aluminosilicate zeolites, especially colloidal zeolite A, provide enhanced builder performance, especially in terms of improved stain removal, reduced fabric encrustation and improved fabric whiteness maintenance. Mixtures of colloidal zeolite A and colloidal zeolite Y are also suitable herein providing excellent calcium ion and magnesium ion sequestration performance.

Surfactant

Suitable surfactants are selected from anionic, cationic, nonionic ampholytic and zwitterionic surfactants and mixtures thereof. Automatic dishwashing machine products should be low foaming in character and thus the foaming of the surfactant system for use in dishwashing should be suppressed or more preferably be low foaming, typically nonionic in character. Sudsing caused by surfactant systems used in laundry cleaning methods need not be suppressed to the same extent as is necessary for dishwashing.

A typical listing of anionic, nonionic, ampholytic and zwitterionic classes, and species of these surfactants, is given in U.S. Pat. No. 3,929,678. A list of suitable cationic surfactants is given in U.S. Pat. No. 4,259,217. A listing of surfactants typically included in automatic dishwashing detergent compositions is given in EP-A-0414549 and WO-A-93/08876 and WO-A-93/08874.

Nonionic Surfactants

Nonionic Ethoxylated Alcohol Surfactants

The alkyl ethoxylate condensation products of aliphatic alcohols with from 1 to 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

End-Capped Alkyl Alkoxylate Surfactants

A suitable endcapped alkyl alkoxylate surfactant is the epoxy-capped poly(oxyalkylated) alcohols represented by the formula:

$$R_1\,O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably 1; and y is an integer having a value of at least 15, more preferably at least 20.

Preferably, the surfactant of formula I, at least 10 carbon atoms in the terminal epoxide unit $[CH_2CH(OH)R_2]$. Suitable surfactants of formula I, according to the present invention, are Olin Corporation's POLY-TERGENT® SLF-18B nonionic surfactants, as described, for example, in WO-A-94/22800.

Ether-Capped Poly(Oxyalkylated) Alcohols

Other suitable surfactants for use herein include ether-capped poly(oxyalkylated) alcohols having the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from 1 to 30 carbon atoms; $R^3$ is H, or a linear aliphatic hydrocarbon radical having from 1 to 4 carbon atoms; x is an integer having an average value from 1 to 30, wherein when x is 2 or greater $R^3$ may be the same or different and k and j are integers having an average value of from 1 to 12, and more preferably 1 to 5.

$R^1$ and $R^2$ are preferably linear or branched, saturated or unsaturated, aliphatic or aromatic hydrocarbon radicals having from 6 to 22 carbon atoms with 8 to 18 carbon atoms being most preferred. H or a linear aliphatic hydrocarbon radical having from 1 to 2 carbon atoms is most preferred for $R^3$. Preferably, x is an integer having an average value of from 1 to 20, more preferably from 6 to 15.

As described above, when, in the preferred embodiments, and x is greater than 2, $R^3$ may be the same or different. That is, $R^3$ may vary between any of the alkyleneoxy units as described above. For instance, if x is 3, $R^3$ may be be selected to form ethyleneoxy(EO) or propyleneoxy(PO) and may vary in order of (EO)(PO)(EO), (EO)(EO)(PO); (EO)(EO)(EO); (PO)(EO)(PO); (PO)(PO)(EO) and (PO)(PO)(PO). Of course, the integer three is chosen for example only and the variation may be much larger with a higher integer value for x and include, for example, mulitple (EO) units and a much small number of (PO) units.

Particularly preferred surfactants as described above include those that have a low cloud point of less than 20° C. These low cloud point surfactants may then be employed in conjunction with a high cloud point surfactant as described in detail below for superior grease cleaning benefits.

Most preferred ether-capped poly(oxyalkylated) alcohol surfactants are those wherein k is 1 and j is 1 so that the surfactants have the formula:

$$R^1O[CH_2CH(R^3)O]_xCH_2CH(OH)CH_2OR^2$$

where $R^1$, $R^2$ and $R^3$ are defined as above and x is an integer with an average value of from 1 to 30, preferably from 1 to 20, and even more preferably from 6 to 18. Most preferred are surfactants wherein $R^1$ and $R^2$ range from 9 to 14, $R^3$ is H forming ethyleneoxy and x ranges from 6 to 15.

The ether-capped poly(oxyalkylated) alcohol surfactants comprise three general components, namely a linear or branched alcohol, an alkylene oxide and an alkyl ether end cap. The alkyl ether end cap and the alcohol serve as a hydrophobic, oil-soluble portion of the molecule while the alkylene oxide group forms the hydrophilic, water-soluble portion of the molecule.

These surfactants exhibit significant improvements in spotting and filming characteristics and removal of greasy soils, when used in conjunction with high cloud point surfactants, relative to conventional surfactants.

Generally speaking, the ether-capped poly(oxyalkylene) alcohol surfactants may be produced by reacting an aliphatic alcohol with an epoxide to form an ether which is then reacted with a base to form a second epoxide. The second epoxide is then reacted with an alkoxylated alcohol to form the novel compounds of the present invention.

Nonionic Ethoxylated/Propoxylated Fatty Alcohol Surfactants

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein.

The hydrophobic portion of these compounds preferably has a molecular weight of from 1500 to 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

Mixed Nonionic Surfactant Systems

The compositions herein can also include a mixed nonionic surfactant system comprising at least one low cloud point nonionic surfactant and at least one high cloud point nonionic surfactant.

"Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer's Encyclopedia of Chemical Technology, 3rd Ed. Vol. 22, pp. 360–379).

As used herein, a "low cloud point" nonionic surfactant is defined as a nonionic surfactant system ingredient having a cloud point of less than 30° C., preferably less than 20° C., and most preferably less than 10° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18), epoxy-capped poly(oxyalkylated) alcohols (e.g., Olin Corporation's Poly-Tergent® SLF18B series of nonionics, as described, for example, in WO-A-94/22800) and the ether-capped poly(oxyalkylated) alcohol surfactants.

Nonionic surfactants can optionally contain propylene oxide in an amount up to 15% by weight. Other suitable nonionic surfactants can be prepared by the processes described in U.S. Pat. No. 4,223,163.

Low cloud point nonionic surfactants additionally comprise a polyoxyethylene, polyoxypropylene block polymeric compound. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC® by the BASF-Wyandotte Corp., Wyandotte, Mich., are also suitable herein. Preferred examples include REVERSED PLURONIC® 25R2 and TETRONIC® 702, Such surfactants are typically useful herein as low cloud point nonionic surfactants.

As used herein, a "high cloud point" nonionic surfactant is defined as a nonionic surfactant system ingredient having a cloud point of greater than 40° C., preferably greater than 50° C., and more preferably greater than 60° C. Preferably the nonionic surfactant system comprises an ethoxylated surfactant derived from the reaction of a monohydroxy alcohol or alkylphenol containing from 8 to 20 carbon atoms, with from 6 to 15 moles of ethylene oxide per mole of alcohol or alkyl phenol on an average basis. Such high cloud point nonionic surfactants include, for example, Tergitol 15S9 (supplied by Union Carbide), Rhodasurf TMD 8.5 (supplied by Rhone Poulenc), and Neodol 91-8 (supplied by Shell).

It is also preferred that the high cloud point nonionic surfactant further have a hydrophile-lipophile balance ("HLB"; see Kirk Othmer hereinbefore) value within the range of from 9 to 15, preferably 11 to 15. Such materials include, for example, Tergitol 15S9 (supplied by Union Carbide), Rhodasurf TMD 8.5 (supplied by Rhone Poulenc), and Neodol 91-8 (supplied by Shell).

Another suitable high cloud point nonionic surfactant is derived from a straight or preferably branched chain or secondary fatty alcohol containing from 6 to 20 carbon atoms ($C_6$–$C_{20}$ alcohol), including secondary alcohols and branched chain primary alcohols. Preferably, high cloud point nonionic surfactants are branched or secondary alcohol ethoxylates, more preferably mixed C9/11 or C11/15 branched alcohol ethoxylates, condensed with an average of from 6 to 15 moles, preferably from 6 to 12 moles, and most preferably from 6 to 9 moles of ethylene oxide per mole of alcohol. Preferably the ethoxylated nonionic surfactant so derived has a narrow ethoxylate distribution relative to the average.

Anionic Surfactants

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactants

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

Mixtures of alkyl sulfate and alkyl ethoxysulfate surfactants are also suitable herein (WO-A-93/18124).

Anionic Sulfonate Surfactants

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2C00^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactants

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Amphoteric Surfactants

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{1-18}$ acylamido alkyl dimethylamine oxide.

A suitable example of an alkyl amphodicarboxylic acid is Miranol(TM) C2M Conc. manufactured by Miranol, Inc., Dayton, N.J.

Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12}$–18 dimethylammonio hexanoate and the $C_{10}$–18 acylamidopropane (or ethane) dimethyl (or diethyl) betaines. Complex betaine surfactants are also suitable for use herein.

Cationic Surfactants

Cationic ester surfactants used in this invention are preferably water dispersible compound having surfactant properties comprising at least one ester (i.e.—COO—) linkage and at least one cationically charged group. Other suitable cationic ester surfactants, including choline ester surfactants, have for example been disclosed in U.S. Pat. No. 4,228,042, U.S. Pat. No. 4,239,660 and U.S. Pat. No. 4,260,529.

Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Enzymes

Enzymes suitable for use herein included cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase and mixtures thereof.

Preferred enzymes include protease, amylase, lipase, peroxidases, cutinase and/or cellulase in conjunction with one or more plant cell wall degrading enzymes.

The cellulases usable in the present invention include both bacterial or fungal cellulase. Preferably, they will have a pH optimum of between 5 and 12 and an activity above 50 CEVU (Cellulose Viscosity Unit). Suitable cellulases are disclosed in U.S. Pat. No. 4,435,307, J61078384 and WO-A-96/02653 which disclose fungal cellulases produced respectively from *Humicola insolens, Trichoderma, Thielavia* and *Sporotrichum.* EP-A-0739982 describes cellulases isolated from novel *Bacillus* species. Suitable cellulases are also disclosed in GB-A-2075028; GB-A-2095275, DE-A-2.247.832 and WO-A-95/26398.

Examples of such cellulases are cellulases produced by a strain of *Humicola insolens* (*Humicola grisea* var. *thermoidea*), particularly the *Humicola* strain DSM 1800, j Other suitable cellulases are cellulases originated from *Humicola insolens* having a molecular weight of 50 KDa, an isoelectric point of 5.5 and containing 415 amino acids; and a ~43 kD endoglucanase derived from *Humicola insolens*, DSM 1800, exhibiting cellulase activity; a preferred endoglucanase component has the amino acid sequence disclosed in WO-A-91/17243. Also suitable cellulases are the EGIII cellulases from *Trichoderma longibrachiatum* described in WO-A-94/21801. Especially suitable cellulases are the cellulases having color care benefits. Examples of such cellulases are cellulases described in EP-0540784 (Novo). Carezyme and Celluzyme (Novo Nordisk A/S) are especially useful. See also WO-A-91/17244 and WO-A-91/21801. Other suitable cellulases for fabric care and/or cleaning properties are described in WO-A-96/34092, WO-A-96/17994 and WO-A-95/24471.

Said cellulases are normally incorporated in detergent compositions at levels from 0.0001% to 2% of active enzyme by weight of composition.

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Peroxidase-containing detergent compositions are disclosed, for example, in WO-A-89/099813, WO-A89/09813 and in EP-0540784. Also suitable is the laccase enzyme.

Preferred enhancers are substitued phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO-A-94/12621) and substitued syringates (C3–C5 substitued alkyl syringates) and phenols. Sodium percarbonate or perborate are preferred sources of hydrogen peroxide.

Said cellulases and/or peroxidases are normally incorporated in detergent composition at levels from 0.0001% to 2% of active enzyme by weight of composition.

Other suitable enzymes that can be included in the detergent compositions of the present invention include lipases. Suitable lipase enzymes for detergent usage include those produced by microorganisms of the *Pseudomonas* group, such as *Pseudomonas stutzeri* ATCC 19.154, as disclosed in GB-A-1,372,034. Suitable lipases include those which show a positive immunological cross-reaction with the antibody of the lipase, produced by the microorganism *Pseudomonas* fluorescent IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticurn* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as MI Lipase$^R$ and Lipomax$^R$ (Gist-Brocades) and Lipolase$^R$ and Lipolase Ultra$^R$(Novo) which have found to be very effective when used in combination with the compositions of the present invention. Also suitables are the lipolytic enzymes described in EP-A-0258068, WO-A-92/05249, WO-A95/22615, WO-A-94/03578, WO-A-95/35381 and WO-A-96/00292.

Also suitable are cutinases [EC 3.1.1.50] which can be considered as a special kind of lipase, namely lipases which do not require interfacial activation. Addition of cutinases to detergent compositions have been described in e.g. WO-A-88/09367, WO-A-90/09446, WO-A-94/14963 and WO-A-94/14964.

The lipases and/or cutinases are normally incorporated in detergent composition at levels from 0.0001% to 2% of active enzyme by weight of composition.

Suitable proteases are the subtilisins which are obtained from particular strains of *B. subtilis* and *B. licheniformis* (subtilisin BPN and BPN'). One suitable protease is obtained from a strain of *Bacillus*, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Proteolytic enzymes also encompass modified bacterial serine proteases, such as "Protease B" or "Protease A" which are modified bacterial serine protealytic enzymes. Please refer to EP-A-199404."Suitable is what is called herein "Protease C", which is a variant of an alkaline serine protease from *Bacillus* in which lysine replaced arginine at position 27, tyrosine replaced valine at position 104, serine replaced asparagine at position 123, and alanine replaced threonine at position 274. Protease C is described in WO-A-91/06637. Genetically modified variants, particularly of Protease C, are also included herein.

A suitable protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO-A-95/10591 and in the patent application of C. Ghosh, et al, "Bleaching Compositions Comprising Protease Enzymes" having U.S. U.S. Pat. No. 5,677,272.

Also suitable are proteases described in EP-A-0251 446 and WO-A-91/06637, protease BLAP® described in WO-A-91/02792 and their variants described in WO-A-95/23221.

See also a high pH protease from *Bacillus* sp. NCIMB 40338 described in WO-A93/18140. Enzymatic detergents comprising protease, one or more other enzymes, and a reversible protease inhibitor are described in WO-A-92/03529. When desired, a protease having decreased adsorption and increased hydrolysis is available as described in WO-A-95/07791. A recombinant trypsin-like protease for detergents suitable herein is described in WO-A-94/25583. Other suitable proteases are described in EP-A-0516 200.

Other suitable protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position +210 in combination with one or more of the following residues: +33, +62, +67, +76, +100, +101, +103, +104, +107, +128, +129, +130, +132, +135, +156, +158, +164, +166, +167, +170, +209, +215, +217, +218 and +222, where the numbered positions correspond to naturally-occurring subtilisin from *Bacillus amyloliquefaciens* or to equivalent amino acid residues in other carbonyl hydrolases or subtilisins (such as *Bacillus lentus* subtilisin). Preferred enzymes of this type include those having position changes +210, +76, +103, +104, +156, and +166.

The proteolytic enzymes are incorporated in detergent compositions at a level of from 0.0001% to 2%, preferably from 0.001% to 0.2%, more preferably from 0.005% to 0.1% pure enzyme by weight of composition.

Amylases (α and/or β) can be included for removal of carbohydrate-based stains. WO-A-94/02597 describes cleaning compositions which incorporate mutant amylases. See also WO-A-95/10603. Other amylases known for use in cleaning compositions include both α- and β-amylases. α-Amylases are known in the art and include those disclosed in U.S. Pat. No. 5,003,257; EP-A-0252,666; WO-A-91/00353; FR-A-2,676,456; EP-A-0285,123; EP-A-525,610; EP-A-0368,341; and GB-A-1,296,839. Other suitable amylases are stability-enhanced anylases described in WO-A-94/18314 and WO-A-96/05295 and amylase variants having additional modification in the immediate parent available from Novo Nordisk A/S, disclosed in WO-A95/10603. Also suitable are amylases described in EP-A-0277216, WO-A-95/26397 and WO-A-96/23873.

Examples of commercial α-amylases products are Purafect Ox Am® from Genencor and Termamyl®, Ban®, Fungamyl® and Duramyl®, Natalase® all available from Novo Nordisk A/S Denmark. WO-A-95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO-A-96/23873. Other amylolytic enzymes with improved properties with respect to the activity level and the combination of thermostability and a higher activity level are described in WO-A-95/35382.

Preferred amylase enzymes include those described in WO-A-95/26397.

The amylolytic enzymes are incorporated in detergent compositions at a level of from 0.0001% to 2%, preferably from 0.00018% to 0.06%, more preferably from 0.00024% to 0.048% pure enzyme by weight of composition.

In a particularly preferred embodiment, compositions herein comprise amylase enzymes, particularly those described in WO-A-95/26397 in combination with a complementary amylase.

By "complementary" it is meant the addition of one or more amylase suitable for detergency purposes. Examples of complementary amylases (a and/or B) are described below. WO-A-94/02597 and WO-A-95/10603 describe cleaning compositions which incorporate mutant amylases. Other amylases known for use in cleaning compositions include both α- and β-amylases. α-Amylases are known in the art and include those disclosed in U.S. Pat. No. 5,003,257; EP-A-0252,666; WO-A91/00353; FR-A-2,676,456; EP-A-0 285123; EP-A-0525610; EP-A-0368341; and GB-A-1,296, 839. Other suitable amylases are stability-enhanced amylases described in WO-A-94/18314 and WO-A-96/05295 and amylase variants having additional modification in the immediate parent available from Novo Nordisk A/S, disclosed in WO-A-95/10603. Also suitable are amylases described in EP-A-0277 216. Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO-A-96/23873. Other amylolytic enzymes with improved properties with respect to the activity level and the combination of thermostability and a higher activity level are described in WO-A95/35382. Preferred complementary amylases for the present invention are the amylases sold under the tradename Purafect Ox Am$^R$ described in WO-A-94/18314, WO-A-96/05295 sold by Genencor; Termamyl®, Fungamyl®, Ban® Natalase® and Duramyl®, all available from Novo Nordisk A/S and Maxamyl® by Gist-Brocades.

The complementary amylase is generally incorporated in detergent compositions at a level of from 0.0001% to 2%, preferably from 0.00018% to 0.06%, more preferably from 0.00024% to 0.048% pure enzyme by weight of composition. Preferably a weight of pure enzyme ratio of specific amylase to the complementary amylase is comprised between 9:1 to 1:9, more preferably between 4:1 to 1:4, and most preferably between 2:1 and 1:2.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Enzymes are normally incorporated in detergent composition at levels from 0.0001% to 2% of active enzyme by weight of composition. The enzymes can be added as separate single ingredients (prills, granulates, stabilized liquids, etc. . . . containing one enzyme) or as mixtures of two or more enzymes (e.g. cogranulates).

Other suitable detergent ingredients that can be added are enzyme oxidation scavengers which are described in copending EP-0553607. Examples of such enzyme oxidation scavengers are ethoxylated tetraethylene polyamines.

A range of enzyme materials and means for their incorporation into synthetic detergent compositions is also disclosed in WO-A-9307263, WO-A-9307260, WO-A-8908694 and U.S. Pat. No. 3,553,139. Enzymes are further disclosed in U.S. Pat. No. 4,101,457 d and U.S. Pat. No. 4,507,219. Enzyme materials useful for liquid detergent formulations, and their incorporation into such formulations, are disclosed in U.S. Pat. No. 4,261,868. Enzymes for use in detergents can be stabilised by various techniques. Enzyme stabilisation techniques are disclosed and exemplified in U.S. Pat. No. 3,600,319, EP-A0199405 and EP-A-0200586. Enzyme stabilisation systems are also described, for example, in U.S. Pat. No. 3,519,570. A useful *Bacillus*, sp. AC13 giving proteases, xylanases and cellulases, is described in WO-A-9401532.

Bleaching Agent

Suitable bleaching agents herein include chlorine and oxygen-releasing bleaching agents. In one preferred aspect the oxygen-releasing bleaching agent contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative aspect a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

Examples of inorganic perhydrate salts include perborate, percarbonate, perphosphate, persulfate and persilicate salts. The inorganic perhydrate salts are normally the alkali metal salts. The inorganic perhydrate salt can be included as the crystalline solid without additional protection. For certain perhydrate salts however, a coated form of the material is used in order to provide better storage stability.

Sodium perborate can be in the form of the monohydrate of nominal formula $NaBO_2H_2O_2$ or the tetrahydrate $NaBO_2H_2O_2.3H_2O$. Alkali metal percarbonates, particularly sodium percarbonate are preferred perhydrates for inclusion herein. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such compositions in a coated form which provides in-product stability.

A suitable coating material providing in product stability comprises mixed salt of a water soluble alkali metal sulphate and carbonate. Such coatings together with coating processes have previously been described in GB-A-1,466,799. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5. Another suitable coating material providing in product stability, comprises sodium silicate of $SiO_2$: $Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating. Coatings that contain silicate and borate salts or boric acids or other inorganics are also suitable. Other coatings which contain waxes, oils, fatty soaps can also be used herein.

Potassium peroxymonopersulfate is another inorganic perhydrate salt of utility in the compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

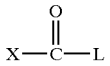

where L is a leaving group and X is essentially any functionality, such that on perhydrolysis the structure of the peroxyacid produced is

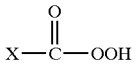

Suitable peroxyacid bleach precursor compounds typically contain one or more N- or O-acyl groups, which precursors can be selected from a wide range of classes.

Suitable classes include anhydrides, esters, imides, lactams and acylated derivatives of imidazoles and oximes. Examples of useful materials within these classes are disclosed in GB-A-1586789. Suitable esters are disclosed in GB-A-836988, GB-A864798, GB-A-1147871, GB-A-2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

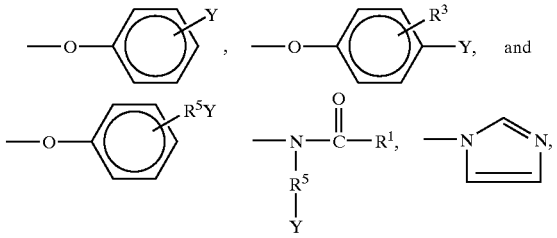

-continued

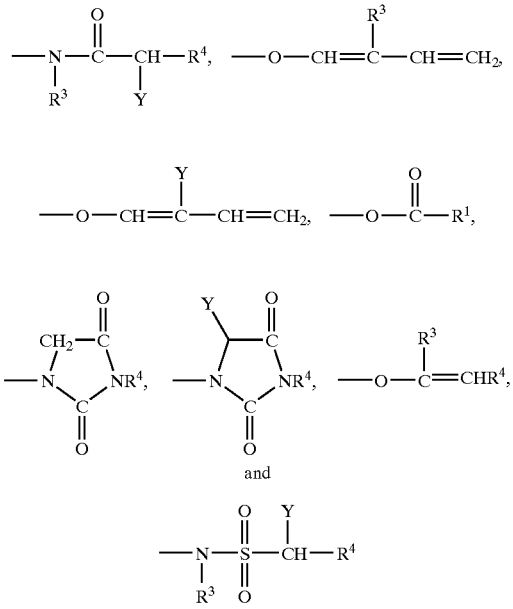

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and R may be substituted by essentially any functional group including, for example alkyl, hydroxy, alkoxy, halogen, amine, nitrosyl, amide and ammonium or alkyl ammonium groups.

The preferred solubilizing groups are $—SO_3^{-M+}$, $—CO_2^-M^+$, $—SO_4^-M^+$, $—N^+(R^3)_4X^-$ and $O<——N(R^3)_3$ and most preferably $—SO_3^-M^+$ and $—CO_2^-M+$wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

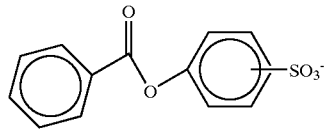

Also suitable are the benzoylation products of sorbitol, glucose, and all saccharides with benzoylating agents, including for example:

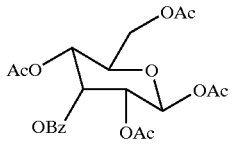

Ac=COCH3; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

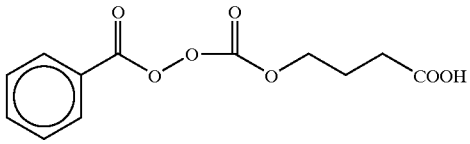

Phthalic anhydride is another suitable perbenzoic acid precursor compound herein:

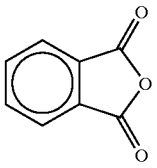

Suitable N-acylated lactam perbenzoic acid precursors have the formula:

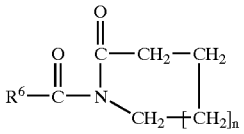

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

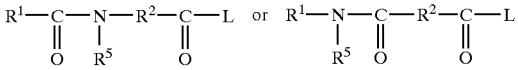

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. No. 4,904,406; U.S. Pat. No. 4,751,015; U.S. Pat. No. 4,988,451; U.S. Pat. No. 4,397,757; U.S. Pat. No. 5,269,962; U.S. Pat. No. 5,127,852; U.S. Pat. No. 5,093,022; U.S. Pat. No. 5,106,528; GB-A-1,382,594; EP-A-0475512, EP-A-0458396 and EP-A-0284292; and in JP87–318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

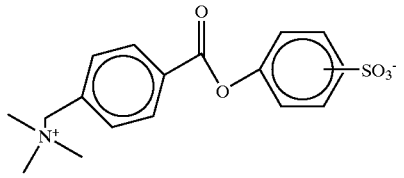

A preferred cationically substituted alkyl oxybenzene sulfonate has the formula:

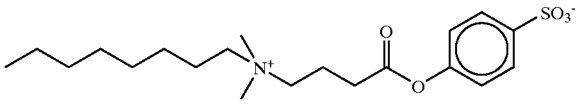

Preferred cationic peroxyacid precursors of the N-acylated caprolactam class include the trialkyl ammonium methylene benzoyl caprolactams, particularly trimethyl ammonium methylene benzoyl caprolactam:

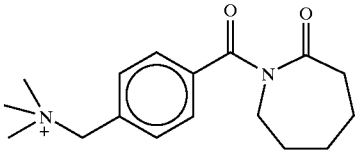

Other preferred cationic peroxyacid precursors of the N-acylated caprolactam class include the trialkyl ammonium methylene alkyl caprolactams:

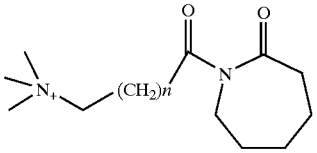

where n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxyacid Precursors

Amide substituted alkyl peroxyacid precursor compounds are also suitable, including those of the following general formulae:

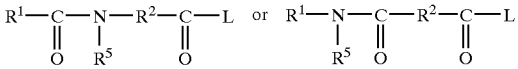

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-01 70386.

Benzoxazin Organic Peroxyacid Precursors

Also suitable are precursor compounds of the benzoxazin-type, as disclosed for example in EP-A-0332294 and EP-A-0482807, particularly those having the formula:

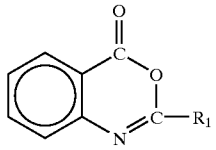

including the substituted benzoxazins of the type

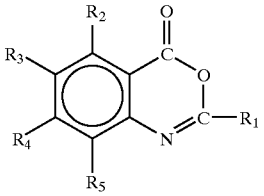

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

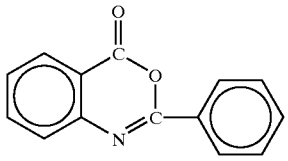

Preformed Organic Peroxyacid

A suitable class of organic peroxyacid compounds are the amide substituted compounds of the following general formulae:

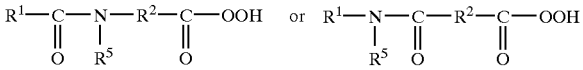

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-01 70386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Controlled Rate of Release—Means

A means may be provided for controlling the rate of release of bleaching agent, particularly oxygen bleach to the wash solution.

Means for controlling the rate of release of the bleach may provide for controlled release of peroxide species to the wash solution. Such means could, for example, include controlling the release of any inorganic perhydrate salt, acting as a hydrogen peroxide source, to the wash solution.

Suitable controlled release means can include confining the bleach to one portion of the composition. Another mechanism for controlling the rate of release of bleach may be by coating the bleach with a coating designed to provide the controlled release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from 1:99 to 1:2, preferably from 1:49 to 1:9. Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof. Other suitable coating materials can comprise the alkali and alkaline earth metal sulphates, silicates and carbonates, including calcium carbonate and silicas.

A preferred coating material, particularly for an inorganic perhydrate salt bleach source, comprises sodium silicate of $SiO_2$: $Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 700,000 and polyethylene glycols (PEG) with an average molecular weight of from 600 to $5\times10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating compositions may also be applied either by being poured onto, or spray atomized onto a moving bed of bleaching agent.

Other means of providing the required controlled release include mechanical means for altering the physical characteristics of the bleach to control its solubility and rate of release. Suitable protocols could include compression, mechanical injection, manual injection, and adjustment of the solubility of the bleach compound by selection of particle size of any particulate component.

Whilst the choice of particle size will depend both on the composition of the particulate component, and the desire to meet the desired controlled release kinetics, it is desirable that the particle size should be more than 500 micrometers, preferably having an average particle diameter of from 800 to 1200 micrometers.

Additional protocols for providing the means of controlled release include the suitable choice of any other components of the composition such that when the composition is introduced to the wash solution the ionic strength environment therein provided enables the required controlled release kinetics to be achieved.

Metal-Containing Bleach Catalyst

Bleach-containing compositions herein can additionally contain a metal containing bleach catalyst. Preferably the metal containing bleach catalyst is a transition metal containing bleach catalyst, more preferably a manganese or cobalt-containing bleach catalyst.

A suitable type of bleach catalyst is a catalyst comprising a heavy metal cation of defined bleach catalytic activity, such as copper, iron cations, an auxiliary metal cation having little or no bleach catalytic activity, such as zinc or aluminium cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Preferred types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$—$(PF_6)_2$, $Mn^{III}_2(u\text{-}O)_1(u\text{-}OAc)_2$(1,4,7-trimethyl-1,4,7-triazacyclononane)$_2$—$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7 -trimethyl-1,4,7-triazacyclononane)$_2$—$(ClO_4)_3$, and mixtures thereof. Others are described in EP-A-0549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof. For other examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$—$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

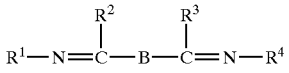

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and bispyridylamine complexes. Highly preferred catalysts include Co(2,2-bispyridylamine)$Cl_2$, Di(isothiocyanato)bispyridylamine-cobalt (II), trisdipyridylamine-cobalt(II) perchlorate, Co(2,2-bispyridylamine)$_2O_2ClO_4$, Bis(2,2'-bispyridylamine) copper(II) perchlorate, tris(di-2-pyridylamine) iron(II) perchlorate, and mixtures thereof.

Preferred examples include binuclear Mn complexes with tetra-N-dentate and bi-N-dentate ligands, including $N_4Mn^{III}(u\text{-}O)_2Mn^{IV}N_4)$+ and $[Bipy_2Mn^{III}(u\text{-}O)_2Mn^{IV}bipy_2]$-$(ClO_4)_3$.

While the structures of the bleach-catalyzing manganese complexes have not generally been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn-ligand species which actually exists, it functions in an apparently catalytic manner to provide improved bleaching performances on stubborn stains such as tea, ketchup, coffee, wine, juice, and the like.

Other bleach catalysts are described, for example, in EP-A-0408131 (cobalt complex catalysts), EP-A-0384503, and EP-A-0306089 (metallo-porphyrin catalysts), US-A4,728,455 (manganese/multidentate ligand catalyst), U.S. Pat. No. 4,711,748 and EP-A0224952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), DE-A-2,054,019 (cobalt chelant catalyst), CA-A-866,191 (transition metal-containing salts), U.S. Pat. No. 4,430,243 (chelants with manganese cations and non-catalytic metal cations), and U.S. Pat. No. 4,728,455 (manganese gluconate catalysts).

Other preferred examples include cobalt (III) catalysts having the formula:

$$Co[(NH_3)_nM'_mB'_bT'_tQ_qP_p]\ Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining co-ordination sites stabilise the cobalt under automatic dishwashing conditions such that the reduction potential for cobalt (III) to cobalt (II) under alkaline conditions is less than 0.4 volts (preferably less than 0.2 volts) versus a normal hydrogen electrode.

Preferred cobalt catalysts of this type have the formula:

$[Co(NH_3)_n(M')_m]\ Y_y$ wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]\ Y_y$, and especially $[Co(NH_3)_5Cl]Cl_2$.

More preferred are the present invention compositions which utilize cobalt (III) bleach catalysts having the formula:

$[CO(NH_3)_n(M)_m(B)_b]\ Ty$ wherein cobalt is in the +3 oxidation state; n is 4 or 5 (preferably 5); M is one or more ligands coordinated to the cobalt by one site; m is 0, 1 or 2 (preferably 1); B is a ligand co-ordinated to the cobalt by two sites; b is 0 or I (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}\ s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, F—, $SO_4$–2, NCS—, SCN—, S203–2, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3$—, $H_2PO_4$—, HOC(O)$CH_2$C(O)O—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —C(O)$NR_{12}$, wherein R' is selected from the group consisting of hydrogen and $C_1$–$C_6$ moieties. Such substituted R therefore include the moieties —$(CH_2)_n$OH and —$(CH_2)_nNR'_4{}^+$, wherein n is an integer from 1 to 16, preferably from 2 to 10, and most preferably from 2 to 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. To be, "Base Hydrolysis of Transition-Metal Complexes", *Adv. Inorg. Bioinorg. Mech.*, (1983), 2, pages 1–94. For example, Table I at page 17, provides the base hydrolysis rates (designated therein as $k_{OH}$) for cobalt pentaamine catalysts complexed with oxalate ($k^{OH}$=2.5×$10^{-4}$ M-1 $s_{-1}$ (25° C.)), NCS— ($k_{OH}$=5.0×$10^{-4}$ $M^{-1}\ s^{-1}$ (25° C.)), formate ($k_{OH}$=5.8×$10^{-4}$ $M^{-1}\ s^{-1}$ (25° C.)), and acetate ($k^{OH}$=9.6×$10^{-4}$ $M^{-1}\ s^{-1}$ (25° C.)). The most preferred cobalt catalyst useful herein are cobalt pentaamine acetate salts having the formula $[Co(NH_3)_5OAc]\ Ty$, wherein OAc represents an acetate moiety, and especially cobalt pentaamine acetate chloride, $[Co(NH_3)_5OAc]C12$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in the To be article hereinbefore and the references cited therein, in U.S. Pat. No. 4,810,410, to Diakun et al, issued Mar. 7, 1989, J. Chem. Ed. (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952); as well as the synthesis examples provided hereinafter.

Cobalt catalysts suitable for incorporation into the detergent tablets of the present invention may be produced according to the synthetic routes disclosed in U.S. Pat. No. 5,559,261, U.S. Pat. No. 5,581,005, and U.S. Pat. No. 5,597,936.

These catalysts may be co-processed with adjunct materials so as to reduce the colour impact if desired for the aesthetics of the product, or to be included in enzyme-containing particles as exemplified hereinafter, or the compositions may be manufactured to contain catalyst "speckles".

Organic Polymeric Compound

Organic polymeric compounds may be added as preferred components of the detergent tablets in accord with the invention. By organic polymeric compound it is meant essentially any polymeric organic compound commonly found in detergent compositions having dispersant, anti-redeposition, soil release agents or other detergency properties.

Examples of organic polymeric compounds include the water soluble organic homo-or co-polymeric polycarboxylic acids, modified polycarboxylates or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N, 480N, 460N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula $-[CR_2—CR_1(COO—R_3)]$ -wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamine and modified polyamine compounds are useful herein including those derived from aspartic acid such as those disclosed in EP-A-0305282, EP-A-0305283 and EP-A-0351629.

Other optional polymers may polyvinyl alcohols and acetates both modified and non-modified, cellulosics and modified cellulosics, polyoxyethylenes, polyoxypropylenes, and copolymers thereof, both modified and non-modified, terephthalate esters of ethylene or propylene glycol or mixtures thereof with polyoxyalkylene units. Suitable examples are disclosed in U.S. Pat. No. 5,591,703, U.S. Pat. No. 5,597,789 and U.S. Pat. No. 4,490,271.

Soil Release Agents

Suitable polymeric soil release agents include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_n OCH_2CH_2O—$, where M is sodium and n is an integer from 4–6, as disclosed in U.S. Pat. No. 4,721,580.

Polymeric soil release agents useful herein also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See EP-A-0219048.

Another suitable soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 and U.S. Pat. No. 3,893,929.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580 and the block polyester oligomeric compounds of U.S. Pat. No. 4,702,857. Other polymeric soil release agents also include the soil release agents of U.S. Pat. No. 4,877,896 which discloses anionic, especially sulfoarolyl, end-capped terephthalate esters.

Another soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1, 2-propyleneoxy units in a ratio of from 1.7 to 1.8, and two end-cap units of sodium 2-(2-hydroxyethoxy)-ethanesulfonate.

Heavy Metal Ion Sequestrant

The tablets of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylenetriamine penta (methylene phosphonate), ethylenediamine tetra(methylene phosphonate) hexamethylenediamine tetra (methylene phosphonate) and hydroxy-ethylene-1, 1-diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Crystal Growth Inhibitor Component

The detergent tablets preferably contain a crystal growth inhibitor component, preferably an organodiphosphonic acid component, incorporated preferably at a level of from 0.01% to 5%, more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Water-Soluble Sulfate Salt

The compositions herein optionally contains a water-soluble sulfate salt. Where present the water-soluble sulfate salt is at the level of from 0.1% to 40%, more preferably from 1% to 30%, most preferably from 5% to 25% by weight of composition.

The water-soluble sulfate salt may be essentially any salt of sulfate with any counter cation. Preferred salts are selected from the sulfates of the alkali and alkaline earth metals, particularly sodium sulfate.

Alkali Metal Silicate

A suitable alkali metal silicate is sodium silicate having an $SiO_2$:$Na_2O$ ratio of from 1.8 to 3.0, preferably from 1.8 to 2.4, most preferably 2.0. Sodium silicate is preferably present at a level of less than 20%, preferably from 1% to 15%, most preferably from 3% to 12% by weight of $SiO_2$. The alkali metal silicate may be in the form of either the anhydrous salt or a hydrated salt.

The compositions herein can also contain sodium metasilicate, present at a level of at least 0.4% $SiO_2$ by weight. Sodium metasilicate has a nominal $SiO_2$: $Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Colourant

The term 'colourant', as used herein, means any substance that absorbs specific wavelengths of light from the visible light spectrum. Such colourants when added to a detergent composition have the effect of changing the visible colour and thus the appearance of the detergent composition. Colourants may be for example either dyes or pigments. Preferably the colourants are stable in composition in which they are to be incorporated. Thus in a composition of high pH the colourant is preferably alkali stable and in a composition of low pH the colourant is preferably acid stable.

Examples of suitable dyes include reactive dyes, direct dyes, azo dyes. Preferred dyes include phthalocyanine dyes, anthraquinone dye, quinoline dyes, monoazo, disazo and polyazo. More preferred dyes include anthraquinone, quinoline and monoazo dyes. Preferred dyes include SANDOLAN E-HRL 180% (tradename), SANDOLAN MILLING BLUE (tradename), TURQUOISE ACID BLUE (tradename) and SANDOLAN BRILLIANT GREEN (tradename) all available from Clariant UK, HEXACOL QUINOLINE YELLOW (tradename) and HEXACOL BRILLIANT BLUE (tradename) both available from Pointings, UK, ULTRA MARINE BLUE (tradename) available from Holliday or LEVAFIX TURQUISE BLUE EBA (tradename) available from Bayer, USA.

The colourant may be incorporated by any suitable method. Suitable methods include mixing all or selected detergent components with a colourant in a drum or spraying all or selected detergent components with the colourant in a rotating drum.

Colourant is typically added at a level of from 0.001% to 1.5%, preferably from 0.01% to 1.0%, most preferably from 0.1% to 0.3% by weight of composition.

Corrosion Inhibitor Compound

The compositions herein, especially for use in dishwashing, can contain a corrosion inhibitor preferably selected from organic silver coating agents, particularly paraffin, nitrogen-containing corrosion inhibitor compounds and Mn(II) compounds, particularly Mn(II) salts of organic ligands.

Organic silver coating agents are described in WO-A-94/16047 and EP-A-690122. Nitrogen-containing corrosion inhibitor compounds are disclosed in EP-A-0634478. Mn(II) compounds for use in corrosion inhibition are described in EP-A-0672 749.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to 40 carbon atoms in the hydrocarbon chain.

The fatty acid portion of the fatty ester can be obtained from mono- or polycarboxylic acids having from 1 to 40 carbon atoms in the hydrocarbon chain.

Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from 35° C. to 11 0° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents can also be used as an organic silver coating agent.

A preferred organic silver coating agent is a paraffin oil, typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of from 1:10 to 2:1, preferably from 1:5 to 1:1. A paraffin oil meeting these characteristics, having a ratio of cyclic to noncyclic hydrocarbons of 32:68, is sold by Wintershall, Salzbergen, Germany, under the trade name WINOG 70.

Nitrogen-Containing Corrosion Inhibitor Compounds

Suitable nitrogen-containing corrosion inhibitor compounds include imidazole and derivatives thereof such as benzimidazole, 2-heptadecyl imidazole and those imidazole derivatives described in Czech Patent No. 139, 279 and GB-A-1,137,741, which also discloses a method for making imidazole compounds.

Also suitable as nitrogen-containing corrosion inhibitor compounds are pyrazole compounds and their derivatives, particularly those where the pyrazole is substituted E in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) Corrosion Inhibitor Compounds

The Mn(II) compound is preferably incorporated at a level to provide from 0.1 ppm to 250 ppm, more preferably from 0.5 ppm to 50 ppm, most preferably from 1 ppm to 20 ppm by weight of Mn(II) ions in bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other Corrosion Inhibitor Compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$-$C_{20}$ fatty acids, or their salts, especially aluminium tristearate. The $C_{12}$–$C_{20}$ hydroxy fatty acids, or their salts, are also suitable. Phosphonated octadecane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Water-Soluble Bismuth Compound

The compositions herein, especially for use in dishwashing, can contain a water-soluble bismuth compound, preferably present at a level of from 0.005% to 20%, more preferably from 0.01% to 5%, most preferably from 0.1% to 1% by weight of composition.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Enzyme Stabilizing System

Preferred enzyme-containing compositions herein can comprise from 0.001% to 10%, preferably from 0.005% to 8%, most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Lime Soap Dispersant Compound

The compositions herein can contain a lime soap dispersant compound, preferably present at a level of from 0.1% to 40% by weight, more preferably 1% to 20% by weight, most preferably from 2% to 10% by weight of composition.

A lime soap dispersant is a material that prevents the precipitation of alkali metal, ammonium or amine salts of fatty acids by calcium or magnesium ions. Preferred lime soap disperant compounds are disclosed in WO-A-93/08877.

Suds Suppressing System

The compositions herein preferably comprise a suds suppressing system present at a level of from 0.01% to 15%, preferably from 0.05% to 10%, most preferably from 0.1% to 5% by weight of composition.

Suitable suds suppressing systems for use herein may comprise essentially any known antifoam compound, including, for example silicone antifoam compounds, 2alkyl and alcanol antifoam compounds. Preferred suds suppressing systems and antifoam compounds are disclosed in WO-A-93/08876 and EP-A-0705324.

Polymeric Dye Transfer Inhibiting Agents

The compositions herein can also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The compositions can also contain from 0.005% to 5% by weight of certain types of hydrophilic optical brighteners.

Hydrophilic optical brighteners useful herein include those having the structural formula:

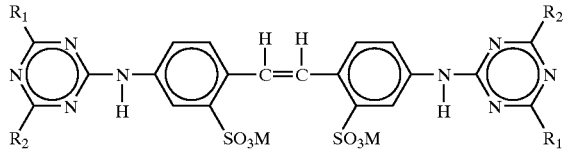

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R^1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R^1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R^1$ is anilino, $R_2$ is morphilino and M is a cation such as sodium, the brightener is 4,4'-bis[(4-anilino-6-morphilino-s-triazine-2-yl)amino]2, 2stilbenedisulfonic acid, sodium salt. This particular brightener species is commercially marketed under the tradename Tinopal AMS-GX by Ciba Geigy Corporation.

Clay Softening System

The compositions herein can contain a clay softening system comprising a clay mineral compound and optionally a clay flocculating agent.

The clay mineral compound is preferably a smectite clay compound. Smectite clays are disclosed in the U.S. Pat. No. 3,862,058, U.S. Pat. No. 3,948,790, U.S. Pat. No. 3,954,632 and U.S. Pat. No. 4,062,647. EP-A-0299575 and EP-A-0313146 describe suitable organic polymeric clay flocculating agents.

Cationic Fabric Softening Agents

Suitable cationic fabric softening agents include the water insoluble tertiary amines or dilong chain amide materials as disclosed in GB-A-1514276 and EP-A-001 1340.

Cationic fabric softening agents are typically incorporated at total levels of from 0.5% to 15% by weight, normally from 1% to 5% by weight.

What is claimed is:

1. A detergent tablet for use in a washing machine, the tablet having two or more phases at least one of which comprises one or more of the following:

a) a polymeric disintegrant having a particle size distribution such that at least 90% by weight thereof has a particle size below about 0.3 mm and at least 30% by weight thereof has a particle size below about 0.2 mm; or b) a water-soluble hydrated salt having a solubility in distilled water of at least about 25 g/100 g at 25° C.;

wherein said salt is selected from hydrates of sodium acetate, sodium metaborate, sodium orthophosphate, sodium dihydrogenphosphate, disodium hydrogen phosphate, sodium potassium tartrate, potassium aluminum sulphate, calcium bromide, calcium nitrate, sodium citrate, potassium citrate and mixtures thereof; and wherein said detergent tablet comprises:

i) a first phase in the form of a shaped body having at least one mould therein, the shaped body being compressed at a pressure of at least about 250 $kg/cm^2$; and ii) a second phase is in the form of a compressed particulate solid affixed within said mould, the compressed particulate solid being compressed at a pressure of less than about 350 $kg/cm^2$.

2. A detergent tablet according to claim 1 wherein the polymeric disintegrant has a particle size distribution such that at least 90% by weight thereof has a particle size below about 0.25 mm and at least 50% by weight thereof has a particle size below about 0.2 mm.

3. A detergent tablet according to claim 1 wherein the polymeric disintegrant has a particle size distribution such that at least 90% by weight thereof has a particle size above about 0.05 mm.

4. A detergent tablet according to claim 3 wherein the polymeric disintegrant has a particle size distribution such that at least 90% by weight thereof has a particle size above about 0.075 mm.

5. A detergent tablet according to claim 1 wherein the polymeric disintegrant is selected from starch, cellulose and derivatives thereof, alginates, sugars, polyvinylpyrrolidones and mixtures thereof.

6. A detergent tablet according to claim 1 wherein the water-soluble hydrated salt is selected from water-soluble mono-, di- tri- and tetrahydrate salts and mixtures thereof.

7. A detergent tablet according to claim 1 wherein the water-soluble hydrated salt has a melting point in the range from about 30° C. to about 95° C.

8. A detergent tablet according to claim 7 wherein the water-soluble hydrated salt has a melting point in the range from about 30° C. to about 75° C.

9. A detergent tablet according to claim 1 containing from about 0.5% to about 10% by weight each of the polymeric disintegrant and water-soluble hydrated salt.

10. A detergent tablet according to claim 1 having a child bite strength (CBS) of at least about 6 kg.

11. A detergent tablet according to claim 10 having a child bite strength (CBS) of greater than about 14 kg.

12. A detergent tablet according to claim 1 wherein the particulate solid is compressed at a pressure of at least about 40 $kg/cm^2$ to less than about 350 $kg/cm^2$.

13. A detergent tablet according to claim 12 wherein the particulate solid is compressed at a pressure of at least about 250 $kg/cm^2$ to less than about 350 $kg/cm^2$.

14. A detergent tablet according to claim 1 wherein the first phase is compressed at a pressure of about 250 $kg/cm^2$.

* * * * *